United States Patent [19]

Salmon

[11] 4,269,105

[45] May 26, 1981

[54] MUSICAL PERCUSSION INSTRUMENT

[76] Inventor: James E. Salmon, 459-11th Ave., #1, San Francisco, Calif. 94118

[21] Appl. No.: 54,765

[22] Filed: Jul. 5, 1979

[51] Int. Cl.[3] ..... G10D 13/02; G10D 13/06

[52] U.S. Cl. ..... 84/402; 84/418; D17/22

[58] Field of Search ..... 84/411–420, 84/402; D17/22

[56] References Cited

U.S. PATENT DOCUMENTS

| | | | |
|---|---|---|---|
| D. 206,134 | 11/1966 | Gussak | D17/22 |
| D. 211,964 | 8/1968 | Valente | 84/418 X |
| 3,779,126 | 12/1973 | Hoey | 84/418 |
| 4,150,602 | 4/1979 | Santiago | 84/402 |

*Primary Examiner*—Lawrence R. Franklin

*Attorney, Agent, or Firm*—Townsend and Townsend

[57] ABSTRACT

A musical percussion instrument combining in a single instrument the striking tones of a clave, the jingling of a tambourine, and the rhythmic grating of a guiro. A wooden handle, doubling as a clave when struck by a striker element, is rigidly attached to a wooden carrier assembly containing apertures for loosely mounting jingles, thereby producing tambourine-like sounds when shaken. A serrated surface of the carrier assembly produces sounds similar to a guiro when the striker element is drawn across it.

4 Claims, 6 Drawing Figures

MUSICAL PERCUSSION INSTRUMENT

FIELD OF INVENTION

This invention relates to the field of musical instruments, particularly percussion musical instruments.

BACKGROUND OF INVENTION

Percussion instruments are practically as old as mankind; and may be nothing more than two pieces of wood that are struck together to produce sound such as, for example, the clave. Other percussion instruments are sounded by striking a sound-producing apparatus (e.g., a drumhead, for example) with a striker element (e.g., a drumstick). Other percussion instruments effect a sound when shaken, such as, for example, a tambourine, or when a striker element is drawn across a surface provided with serrations. The Latin American guiro is an example of the latter.

Further, it is known to combine certain percussion instruments in one; see, for example, U.S. Pat. Nos. 3,566,737 and 2,472,408. Most instruments have generally been limited in the sounds they were capable of producing, such as a shaker with jingles or a castanet with jingles. Others have been mere aggregations of percussion-type devices brought together with no thought or design for producing a serious, unified musical percussion instrument capable of selectively producing a variety of sounds. A number of devices stuck on a pole is one example. The prior art combinations have often been rather clumsy affairs fatiguing the musician who may have been required to use them for an extended period. Examples of such prior art musical devices can be found in U.S Pat. Nos. 3,566,737 and 3,704,340.

SUMMARY OF THE INVENTION

Accordingly, the present invention presents a percussion instrument capable of selectively generating the jingling sound of a tambourine, the striking tones of a clave accompanied by the tambourine sound, or the combined rhythmic grating of a guiro and tambourine-like jingling. The invention includes a handle which doubles as a clave when struck by a striker element. Rigidly attached to the handle is a carrier assembly containing apertures for loosely mounting a number of jingles for producing tambourine-like sounds when shaken or otherwise caused to vibrate. One surface of the carrier is serrated to produce sounds of a guiro when the striker element is drawn across it.

In the preferred embodiment of the invention, the entire structure, except for the jingles, is wooden. The handle is a cylindrically shaped, elongate piece to which is attached the carrier assembly. The carrier assembly includes a spaced pair of elongate, parallel, wooden carrier members that are attached to one end of the handle and extend in a direction generally parallel to the handle's longitudinal axis. Each carrier member has formed along its length a number of apertures in which are mounted conventional tambourine-like jingles; and one longitudinal edge of each carrier member is serrated, the edges being placed side-by-side when the carrier members are attached to the handle.

In an alternate embodiment of the invention, the carrier assembly is formed from a single, elongate carrier member shaped in an arcuate configuration with the ends being attached to one end of the handle.

Further, the jingles used in either of the embodiments disclosed herein can be fabricated from a metallic material. Alternately, it has been found that use of wooden or even plastic jingles provides some interesting and unusual sounds and effects when utilized in the present invention.

One object of this invention is to create a musical instrument which combines the jingling sounds of a tambourine with the striking of a clave and also with the rhythmic grating of a guiro. The advantage in this arrangement is that the musician, when striking the clave or drawing the striker against the guiro, also produces an accompanying tambourine-like jingling sound—a unique composite effect not reproducible with two separate instruments.

Another object of this invention is to combine three percussion musical instruments into one, thereby providing musicians greater flexibility in their musical arrangements.

A further object of this invention is to provide the musician with the ability to produce more varied and pronounced jingle accents using only one hand, as opposed to that obtainable from a tambourine.

This is obtained by providing structure that allows the jingles to be shaken by the same wrist action as that utilized in the maraca technique; that is, the handle of the invention allows use of a wrist technique to snap the jingles of the carrier assembly forward and back with much greater authority and control than can be obtained by grasping the rim of a tambourine. By rigidly attaching the handle to the carrier assembly which houses the jingles, the musician is provided with control that allows him or her to produce accents by one-handed action. Further, with an embodiment of the present invention in each hand and striking the carrier assembly against another object, a combination of jingles, accents, poly-rhythms, counterbeats, and main beats can be achieved. If the other object is also sound-producing, the still further interesting rhythms and effects can be obtained.

A slightly different effect is achieved by striking the handle with the striker element to obtain a clave-jingle sound combination.

For a better understanding of the present invention, together with other and further features thereof, reference is had to the following description taken in conjunction with the accompanying drawings, the scope of the invention being pointed out in the claims.

DETAILED DESCRIPTION OF THE INVENTION

Figure 1:
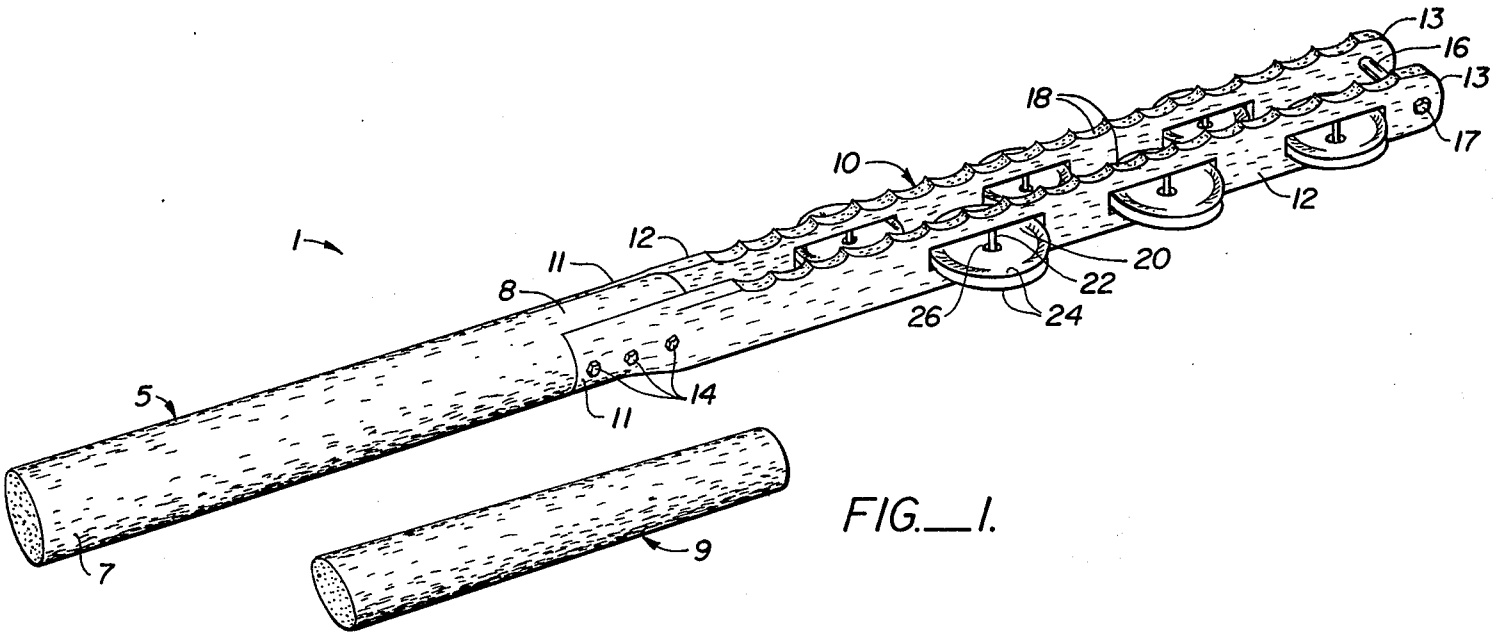
FIG. 1 is a perspective view illustrating a preferred embodiment of the invention.
Figure 2:
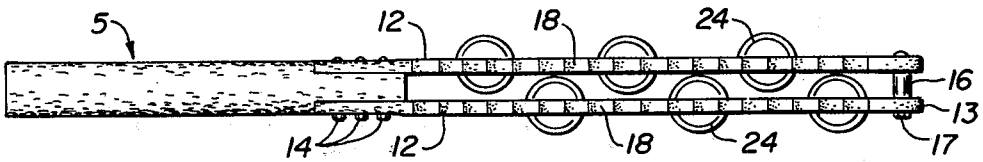
FIG. 2 is a top plan view of the embodiment of FIG. 1.
Figure 3:
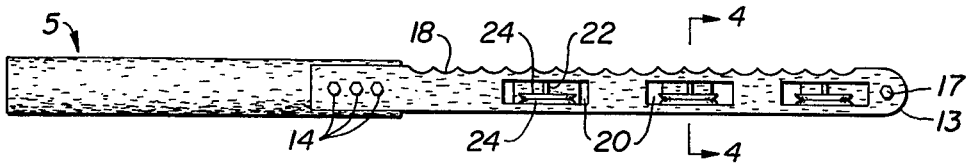
FIG. 3 is a side view of the embodiment of FIG. 1.
Figure 4:
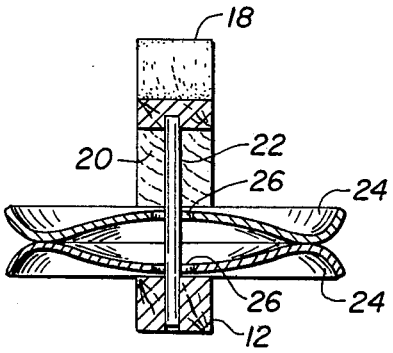
FIG. 4 is a cross-sectional view of one of the carrier members of the invention, taken along lines 4—4 of FIG. 3, illustrating the use of metal jingles.

At FIG. 1, a preferred embodiment of the invention is shown and designated generally by the reference numeral 1. As illustrated, the invention includes a cylindrically shaped handle 5, having opposed ends 7 and 8. Preferably, the handle 5 is provided with a length of sufficient dimension to allow a portion of the handle to be exposed for striking by the striker 9 while the handle 5 is grasped in a user's hand.

Attached to handle end 8 of handle 5 is a carrier assembly 10 which includes a pair of spaced, parallel carrier members 12, 12 of approximately equal size. The handle ends 11, 11 of the respective carrier members 12, 12 are attached to the handle 5 so that they extend longitudinally therefrom via any appropriate attachment mechanism such as, for example, bolts 14. The parallel configuration of the carrier members 12, 12 is maintainted by a spacer 16 that is mounted to and between the free ends 13, 13 of the carrier members 12, 12 by a spacer bolt 17. One longitudinal edge 18 of each carrier member 12, 12 is serrated, the serrated edges 18 being located side-by-side, as illustrated.

Formed in each carrier member 12 is a number of generally rectangular apertures 20. Mounted in each aperture 20 by a mounting pin 22 is a pair of generally disk-like jingles 24. Each jingle 24 has formed therein a centrally located aperture 26 through which the mounting pin 22 passes to hold the jingles 24 in each aperture 20.

In order to provide a smooth unitary structure, the attached end 8 of the handle 5 is configured to allow the handle ends 11, 11 of the carrier members 12, 12 to seat therein. Further, the ends of the bolts 14 may be recessed into the handle ends 11, 11 to produce a smooth gripping surface and the handle ends 11 are shaped to conform generally with the cylindrical shape of the handle 5, thereby allowing the handle 5 to be grasped anywhere along its length.

Preferably, the handle 5 and striker 9 are fabricated from rosewood so that when struck together, the deep, rich tones typically associated with a clave are produced. The carrier members 12 of the carrier assembly 10 are preferably fabricated from a hardwood, such as oak, so that the serrated edges 18 will withstand long usage as a guiro. The jingles 24, which in the embodiment shown in FIGS. 1–4 made from a metallic material, are the same as those commonly used in tambourines and are commercially available from any percussion or music store.

Figure 5:
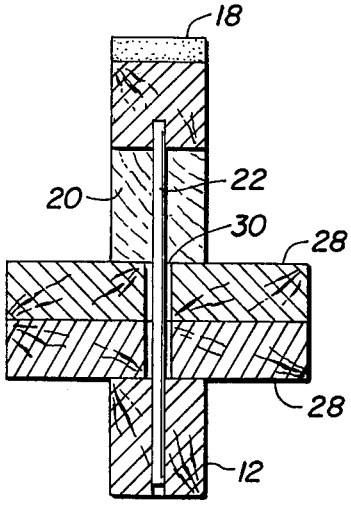
FIG. 5 is a cross-sectional view of one of the carrier members of the invention, illustrating the use of wooden jingles.

It has been found that providing the invention 1 with jingles made of wood, a sound and effect quite different from metallic jingles can be produced. Thus, as illustrated in FIG. 5, the apertures 20 of the carrier members 12 have mounted therein a pair of circular disks 28, replacing the metal jingles 24 of FIGS. 1–4. The circular disks are preferably fabricated from rosewood and have formed therein a centrally located aperture 30 through which mounting pin 22 passes for mounting the disks 28 to each carrier member 12.

In use, one need merely grasp the handle 5 and commence a reciprocating motion of the handle 5 and attached carrier assembly 10 to cause the jingles 24 (or jingles 28 of FIG. 5) to strike one another and the periphery of aperture 20. It should be evident that the structure of the invention allows one to produce more motion in the carrier assembly 10 and, therefore, the jingles 24, with minimum of motion being imparted to that handle to obtain the tambourine sound; that is, it takes less effort to shake the jingles 24 (or 28, as the case may be). Thus, a performer may use the invention for longer periods before tiring.

Using the striker 9, one may obtain the deep, dry sound of the clave with a tambourine-like background accompaniment by striking the handle 5 with the striker 9. Alternately, a rasping guiro effect—again with a tambourine-like background—is obtained when the striker is drawn along the serrated edges 18 of the carrier assembly 12.

Figure 6:
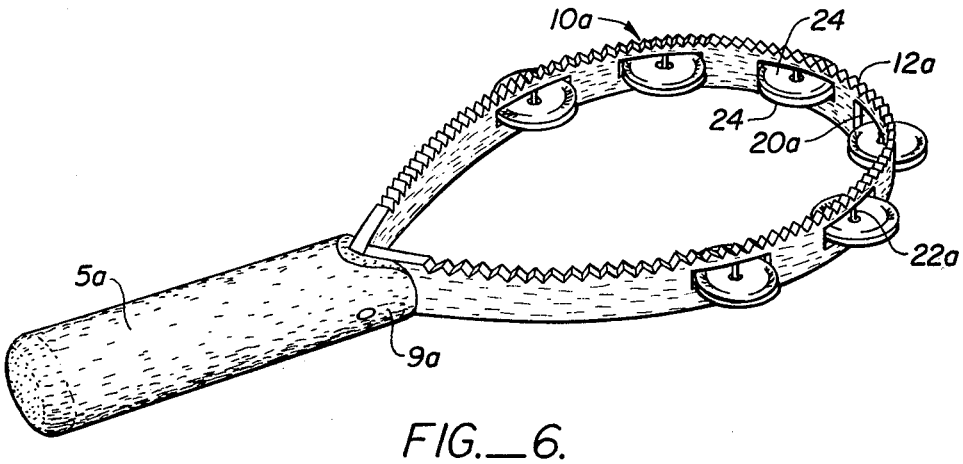
FIG. 6 is a perspective view of an alternate embodiment of the invention.

An embodiment of the present invention is shown at FIG. 6. As illustrated, a carrier assembly **10*a* includes a single annular carrier member 12*a* that is attached to handle 5*a*. The carrier member 12*a* has formed therein a number of apertures 20*a* that open radially thereof. As with the preferred embodiment of FIGS. 1–4, the apertures 20*a* each have mounted therein a pair of jingles 24*a* via a mounting pin 22*a*. One edge 18*a* of the carrier member 12*a*** is serrated.

The carrier assembly **10*a* is preferably fabricated from rattan wood, which is easier to bend to the required annular shape shown in FIG. 6. The handle 5*a* can be fabricated from rosewood, thereby providing the deep, rich clave tones (with a tambourine-sounding background) when struck. However, to provide a lightweight instrument that can be used for many hours by a musician without tiring, the handle 5*a*** can also be made of rattan wood. The use of this embodiment is essentially the same as that described for the preferred embodiment.

It will be apparent to those skilled in the art that a multitude of varying sounds can be provided by changing sizes, numbers of jingles, spacings of corrugations, materials used, and so forth. For example, wooden or even plastic jingles, shown at FIG. 5, will produce a much different sound compared with metal jingles. The variations and embodiments of this invention are numerous. Therefore, the scope of this invention is limited only by the scope of the following claims.

What is claimed is:

1. A musical percussion instrument comprising:

a generally cylindrical, elongate dual purpose clave-handle, said clave-handle being of sufficient length to allow a portion thereof to be exposed when grasped by a user so that the exposed portion can be struck by the user to produce a first sound;

a carrier assembly fixedly attached to one end of said handle and relatively oriented to generally lie in a plane defined by said handle, the carrier assembly including at least one elongate carrier element having formed therein a plurality of apertures, said carrier element including at least one edge having serrations along at least a portion of said edge to produce a second sound when the user draws an object across the serrations; and at least one disk-like jingle loosely mounted within each one of said plurality of apertures and relatively oriented transverse said carrier element so that when said handle or carrier assembly is shaken, said jingles will generate third sound.

2. The musical percussion instrument of claim 1 including a generally cylindrical striker for striking the clave-handle to produce said first sound or for drawing across the serrations of said carrier element to produce said second sound.

3. The musical percussion instrument of claim 2 wherein said striker and clave-handle are rosewood and said serrated carrier element is oak.

4. A musical percussion instrument comprising:

a generally cylindrical, elongate dual purpose clave-handle, said clave-handle being of sufficient length to allow a portion thereof to be exposed when grasped by a user so that the exposed portion can be struck by the user to produce a first sound;

a carrier assembly attached to one end of said handle and oriented to lie generally in a plane defined by said handle, the carrier assembly including at least one elongate carrier element having formed therein a plurality of apertures;

at least one disk-like jingle loosely mounted within each one of said plurality of apertures and relatively oriented transverse to said carrier element so that when said handle or carrier assembly is shaken, said jingles will generate a second sound;

said carrier element having at least one edge having serrations along at least a portion of said edge to produce a third sound when the user draws an object across the serrations; and a generally cylindrical striker separate from said clave-handle and carrier assembly for striking the clave-handle to produce said first sound or for drawing across the serrations on said carrier element to produce said third sound.

* * * * *